US007481003B2

(12) United States Patent
Garza

(10) Patent No.: US 7,481,003 B2
(45) Date of Patent: Jan. 27, 2009

(54) FOOTBALL DOWN CHAIN SET

(76) Inventor: Richard Garza, 11901 NW. 11th St., Pembroke Pines, FL (US) 33026

( * ) Notice: Subject to any disclaimer, the term of this patent is extended or adjusted under 35 U.S.C. 154(b) by 43 days.

(21) Appl. No.: 11/788,990

(22) Filed: Apr. 23, 2007

(65) Prior Publication Data

US 2008/0256811 A1 Oct. 23, 2008

(51) Int. Cl.
*G01B 11/26* (2006.01)
*G01C 15/00* (2006.01)

(52) U.S. Cl. ..... 33/289

(58) Field of Classification Search ..... 33/289, 33/227, 263, 755
See application file for complete search history.

(56) References Cited

U.S. PATENT DOCUMENTS 1,645,707 A 10/1927 Lipp
1,684,566 A 9/1928 Winkler
2,064,745 A * 12/1936 Harrie ..... 33/759
3,213,824 A * 10/1965 Jenkins ..... 33/579
3,678,592 A 7/1972 Williamson
3,738,014 A 6/1973 Sproul, Sr.
3,768,435 A * 10/1973 Dicker ..... 33/289
4,747,725 A 5/1988 Gebelius
5,189,803 A * 3/1993 Caywood ..... 33/289
6,012,228 A 1/2000 Fisanich
6,851,198 B1 * 2/2005 Harty ..... 33/289
6,851,199 B1 * 2/2005 Zeitz ..... 33/289
2008/0184571 A1 * 8/2008 Kivley ..... 33/289

* cited by examiner

*Primary Examiner*—Yaritza Guadalupe-McCall
(74) *Attorney, Agent, or Firm*—Laurence A. Greenberg; Werner H. Stemer; Ralph E. Locher

(57) ABSTRACT

A football down chain set for monitoring the position of a football. The chain set includes a standard having a pointer attached thereon. The pointer is spaced at a distance from the standard. The pointer gauges a position of the football. Another standard has another pointer attached thereon. The other pointer is spaced at a distance from the other standard, the other pointer gauges a position of the football. A strap interconnects the standard and the other standard. The strap is dimensioned for providing a spacing of ten yards between the pointer and the other pointer.

17 Claims, 7 Drawing Sheets

FOOTBALL DOWN CHAIN SET

BACKGROUND OF THE INVENTION

1. Field of the Invention

The invention relates to an apparatus for keeping track of downs and yardage required for a first down in a football game, more specifically, to a chain set which separates the standard from the down marker and which has several safety and accuracy features.

2. Description of the Related Art

In the game of football, the team on offense must advance the ball ten yards within four plays to retain possession of the ball by obtaining a first down. It is prior-art practice, in the game of football to use a chain set that includes two standards connected to one another by a chain. The standards are used to designate the start and finish of the ten yards. A down marker is used to indicate the position of the ball on the field, known as the line of scrimmage. The down marker also indicates the current down being played. The chain set is used on the sidelines and is brought out onto the field in the event of a measurement for a first down, when it is not clear that enough yardage has been gained to obtain a first down.

Prior art chain sets have the following disadvantages. In the situation when it is first down and ten yards to go (which is often a case during the game), the down marker and the standard must be at the same location. This can lead to a dangerous situation if the play advances toward the chain set and the crew operating the chain set must avoid or try to move out of the way of the player or players advancing towards the chain set. Furthermore, the chain does not provide any accurate indication or measurement as to the yardage remaining for obtaining a first down. Also, the standards and the down markers are typically provided as rigid tubes and they do not have any give. This creates a risk of injury for the chain crew as well as the players, particularly in a game were the chain crew members are adults and the players are youths.

SUMMARY OF THE INVENTION

It is accordingly an object of the present invention to provide a football down chain set which overcomes the above-mentioned disadvantages of the heretofore-known devices of this general type and which provides a chain set that creates a gap or separation between the down marker and the standards in situations when there are ten yards remaining for obtaining a first down, which is easy to use, easily manufactured, easy to maintain, is durable, and reliable.

With the foregoing and other objects in view there is provided, a football down chain set for monitoring the position of a football. The chain set includes a standard having a pointer attached thereon. The pointer is spaced at a distance from the standard. The pointer gauges a position of the football. Another standard has another pointer attached thereon. The other pointer is spaced at a distance from the other standard, the other pointer gauges a position of the football. A strap interconnects the standard and the other standard. The strap is dimensioned for providing a spacing of ten yards between the pointer and the other pointer In accordance with another feature of the invention, the standards have a break away construction.

In accordance with a further feature of the invention, the standards each have respective pole segments held together by an elastic cord.

In accordance with an added feature of the invention, one of the pole segments is disposed inside the other of the pole segments, which has a cutout for allowing the pole segments to break away from each other.

In accordance with an additional feature of the invention the strap has graduations spaced at one yard increments. The graduations are labeled from 1 to 5 in a direction from the standards towards a center of the strap.

In accordance with yet another feature of the invention, the standards each have respective eye bolts. The strap is attached to the eye bolts by clip on fasteners.

In accordance with yet a further feature of the invention, a down marker indicates a current down and a line of scrimmage.

In accordance with yet an added feature of the invention, the down marker has a mesh banner indicator for indicating a current down and the standards each have respective mesh banner directional indicators.

In accordance with yet an additional feature of the invention, the pointers are constructed to rotate about an axis that is parallel to the strap.

In accordance with still another feature of the invention, the pointers are perpendicular to the strap.

In accordance with still a further feature of the invention, there is a respective pointer assembly for each the standard. Each pointer assembly has an extension tube connected to a clip for attaching to the respective standard. One of the pointers is connected to the extension tube for establishing the spacing. The pointer assembly is constructed for allowing a respective pointer to rotate about an axis parallel to the strap.

In accordance with yet still a further feature of the invention, the pointers are perpendicular to the strap.

In accordance with yet still another feature of the invention, an elastic band holds the extension tube securely against the clip.

In accordance with yet still another added feature of the invention a jawed clip clamps onto the strap in a locked manner. The jawed clip aligns the chain set during an on field measurement.

With the objects of the invention in view, there is also provided a method for safely spacing apart markers during a football game. The method includes providing standards each having a respective pointer attached thereon, the respective pointer is spaced at a distance from the standard. The pointers gauge a position of the football, a strap interconnects the standards, and the strap is dimensioned for providing a spacing of ten yards between the pointers. A down marker indicates the down and the line of scrimmage. Placing the down marker at the corresponding pointer when ten yards remain for a first down, thereby safely spacing members of a chain crew from one another.

Other features which are considered as characteristic for the invention are set forth in the appended claims.

Although the invention is illustrated and described herein as embodied in a football down chain set, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
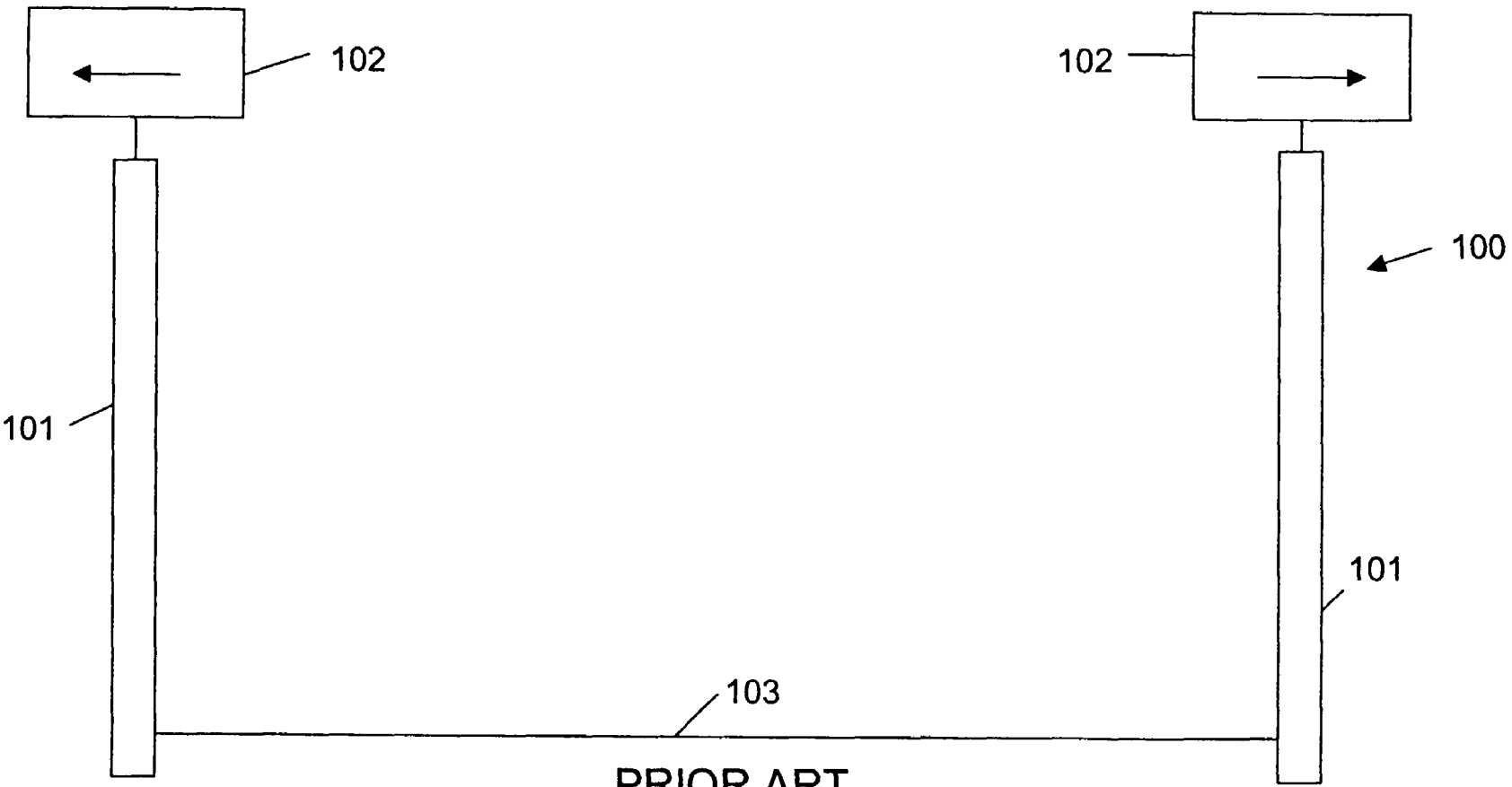
PRIOR ART FIG.1
FIG. 1 is a drawing of an existing prior art chain set.

Referring now to the figures of the drawing in detail and first, particularly, to FIG. 1 thereof, there is shown a chain set 100 that has been designated as prior art. The chain set 100 includes two standards 101 with direction indicators 102.

A chain 103 connects the standards 101 to one another. The chain set 100 is used by placing one of the standards 101 in line with the nose of a football on first down. The opposite standard 101 is spaced at ten yards down field and determines the position required for making a first down. A down marker is used to indicate the line of scrimmage and the current down. When there are ten yards to go for a first down, the down marker must be placed at the same location on the sideline as the standard 101. Use of the chain set 100 requires three crew members, one for each standard and one for the down indicator. In the situation when there are ten yards remaining and the standard and the down marker must be in the same spot, the crewmembers are forced to be crowded next to one another.

Figure 2A:
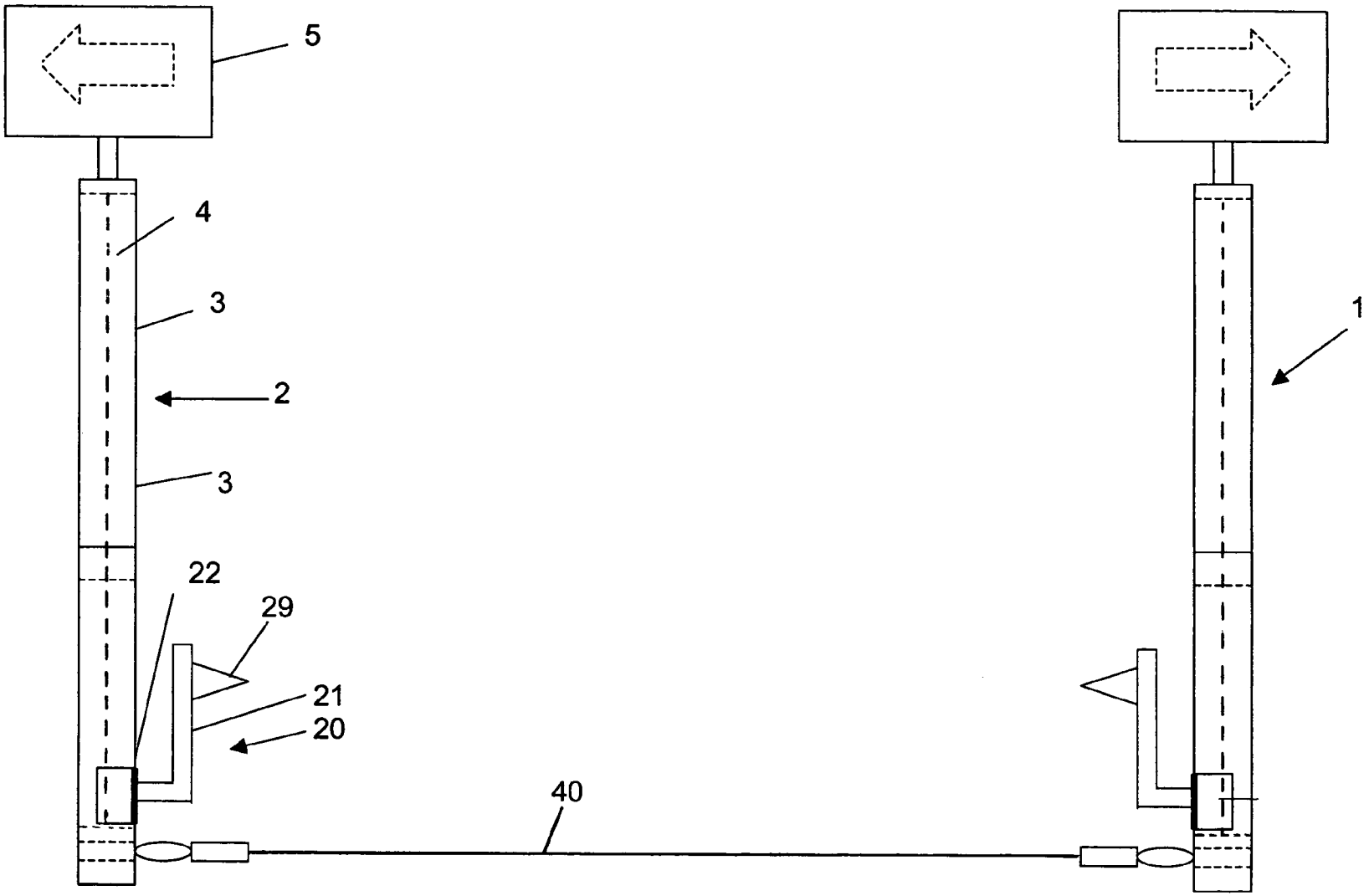
FIG. 2A is a view of a chain set according to the present invention with pointer assemblies.
Figure 2C:
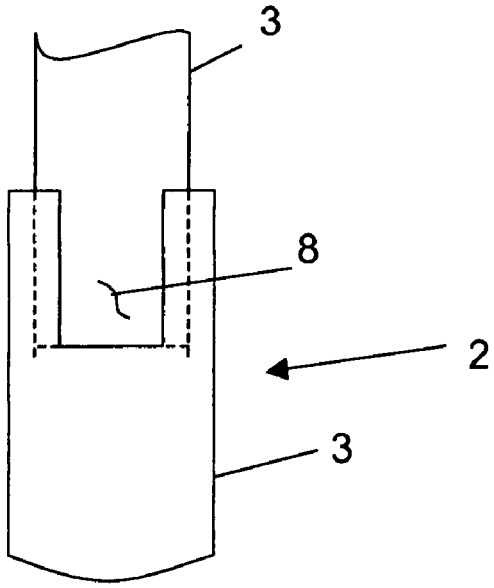
FIG. 2C is an enlarged side-elevational view of a connecting region between poles segments of the standard of the present invention.
Figure 2B:
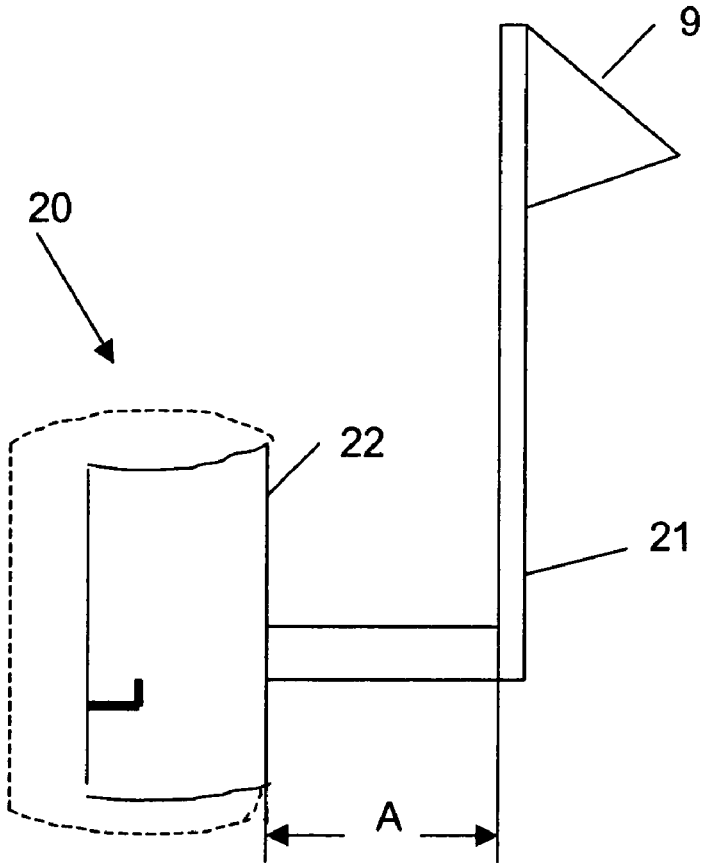
FIG. 2B is a side-elevational view of the pointer assembly of the present invention.

FIGS. 2A, 2B, and 2C show a marker or standard 2 of the chain set 1 of the present invention. The standards 2 of the chain set 1 are constructed as break away standards 2. The break away standards 2 have at least two individual rigid pole segments 3 that are connected to each other by an elastic cord 4 that is attached at opposing ends of the pole segments 3. The pole segments 3 fit inside one another and the larger diameter or outer pole may have a cutout 8 in its wall or diameter. The cutout 8 is positioned away from the field of play and corresponds closely to the depth that the inner pole 3 engages the outer pole 3. When a player makes contact with the standard 2 it will break away or deform without being permanently broken and help prevent injury to the players and chain crew. After the pole has been dislodged in this manner, it is very simple to place the inner pole segment 3 back into the outer pole segment 3 and have the standard 2 be fully functional again. The pole segments 3 may include shoulders to set the depth that the pole segments 3 engage one another. While the standards 2 are illustrated as having two pole segments 3, it is possible that the standards 2 have more than two pole segments 3.

A directional indicator 5 is rotatably mounted to the top of the standard 2. The directional indicator 5 may be provided as a mesh banner for reducing wind resistance, thereby making the chain set easier and safer to use in windy weather.

Figure 4:
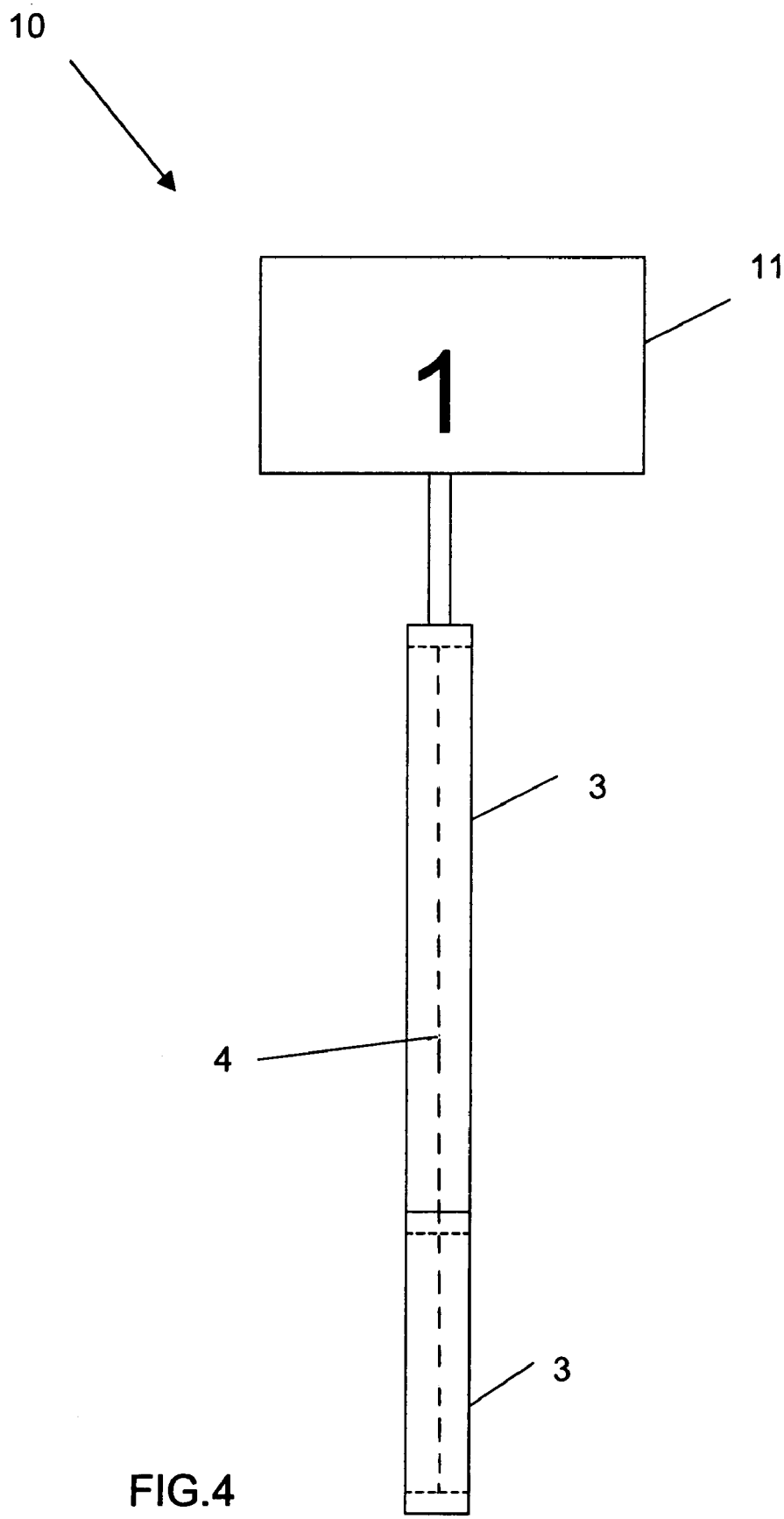
FIG. 4 is a side elevational view of the down marker of the present invention.

FIG. 4 shows a down marker 10, which is constructed of the same pole segments 3 as the standards 2. The pole segments 3 are configured to be of the same break away construction as disclosed above for the standards 2. A down indicator 11 stating the current down is disposed on the down marker 10 Likewise, the down indicators 11 may be provided as mesh banners, the same as direction indicators 5. The down indicators 11 are numbered 1-4. In use, the down marker 10 is placed at the line of scrimmage and indicates the present down. Both the down marker 10 and the standards 2 may be provided with a padded sleeve (not shown) for providing further protection against injury.

The standards 2 each have a pointer assembly 20 disposed thereon. The pointer assembly 20 includes a pointer or indicator 21, which gauges the position of the football. The pointer 21 is shown as a rod that is rigid, while at the same time it is possible for the rod to also be flexible, similar to a two-way radio antenna, so as to prevent injury to a player or crew member. The pointer 21 is spaced at a spacing A from the standard, which allows separation of crew members when ten yards remain for obtaining a first down. The spacing A can be any distance that is does not make the chain set 1 cumbersome and is preferably in the range of 4-12 inches. The pointer assembly is constructed so that the pointer 21 is able to rotate from a vertical position into a position where it is able to engage or contact the football for determining if a first down has been made. The rotation of the pointer 21 provides an accurate measurement of the position of the football and the pointer may be constructed to rotate 360°. The pointer 21 may include a flag or marker 29 for easy visual identification.

Figure 6:
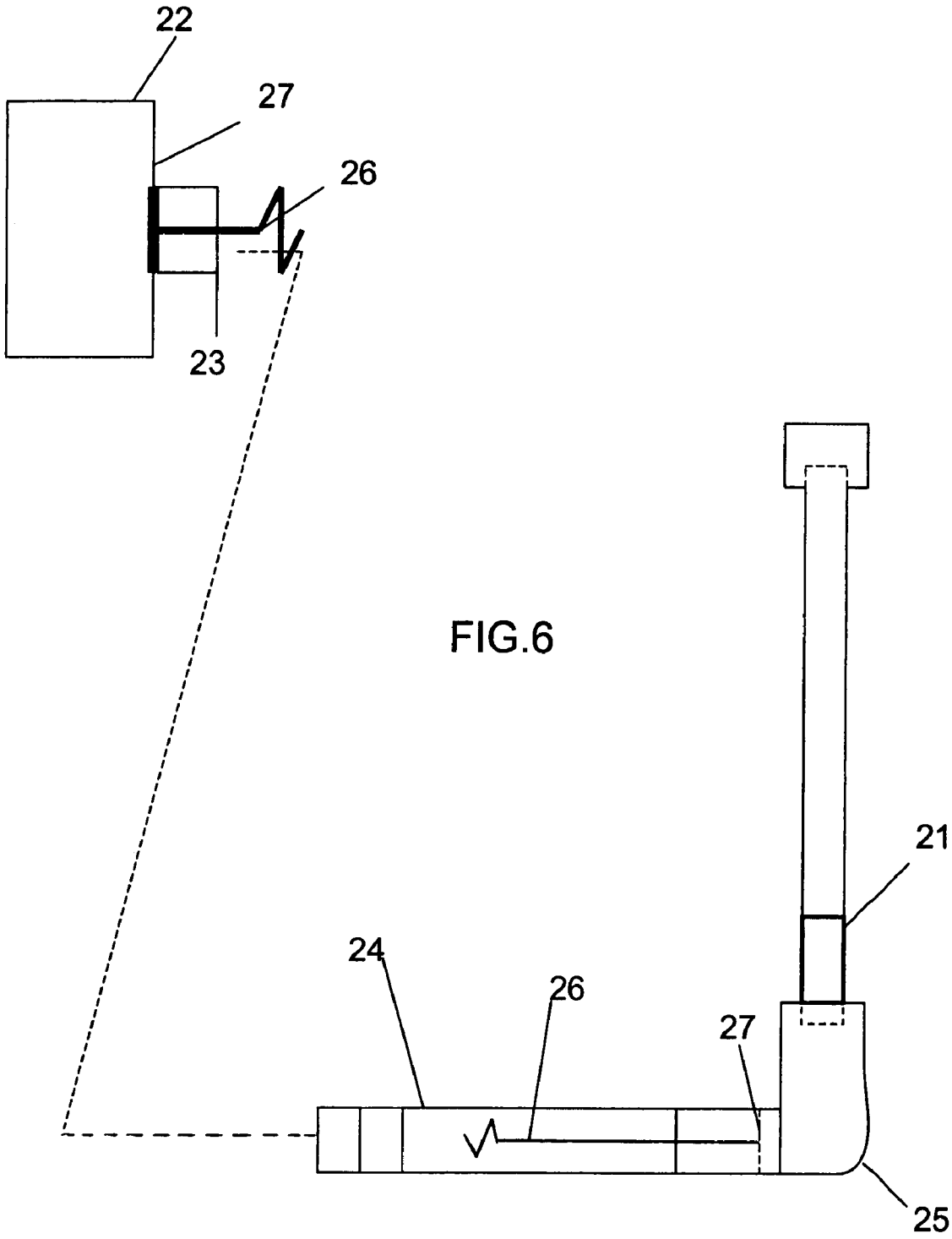
FIG. 6 is an exploded plan view of the pointer assembly according to the present invention.

The pointer assembly 20 can be constructed to include a clip 22 for removably mounting the pointer assembly 20 to the standard 2. The pointer assembly 20 may also be rigidly fixed to the standard. The clip 22 and the standard 2 have a locator for ensuring a proper alignment of the clip 22 on the standard 2. As seen in FIG. 6, on the side of the clip 22 opposite of the standard 2, a mounting 23 is provided for an extension tube 24, which separates the pointer 21 from the standard 2. A 90° elbow 25 connects the extension tube 24 to the pointer 21. At least one of the connections of the extension tube 24 allows a rotation of the pointer 21 with respect to the clip 22 and thus with respect to the standard 2. Furthermore, the clip 22 may be constructed to rotate about the standard 2 so that the pointer 21 may be positioned behind the standard (away from the field), as a safety feature, when it is not being used. An elastic cord 26 attached to pins 27 forces the elbow 25 and the extension tube 24 against the clip 22. The pointer 21 may have a rubber tip as a safety feature. On first down and 10 yards to go, the pointer 21 provides the spacing A between the standard 2 and the down marker 10. The spacing A is a safety feature that separates the members of the crew from one another so that in the event that the play advances towards the crew, they can make evasive maneuvers without running into one another.

Figure 3:
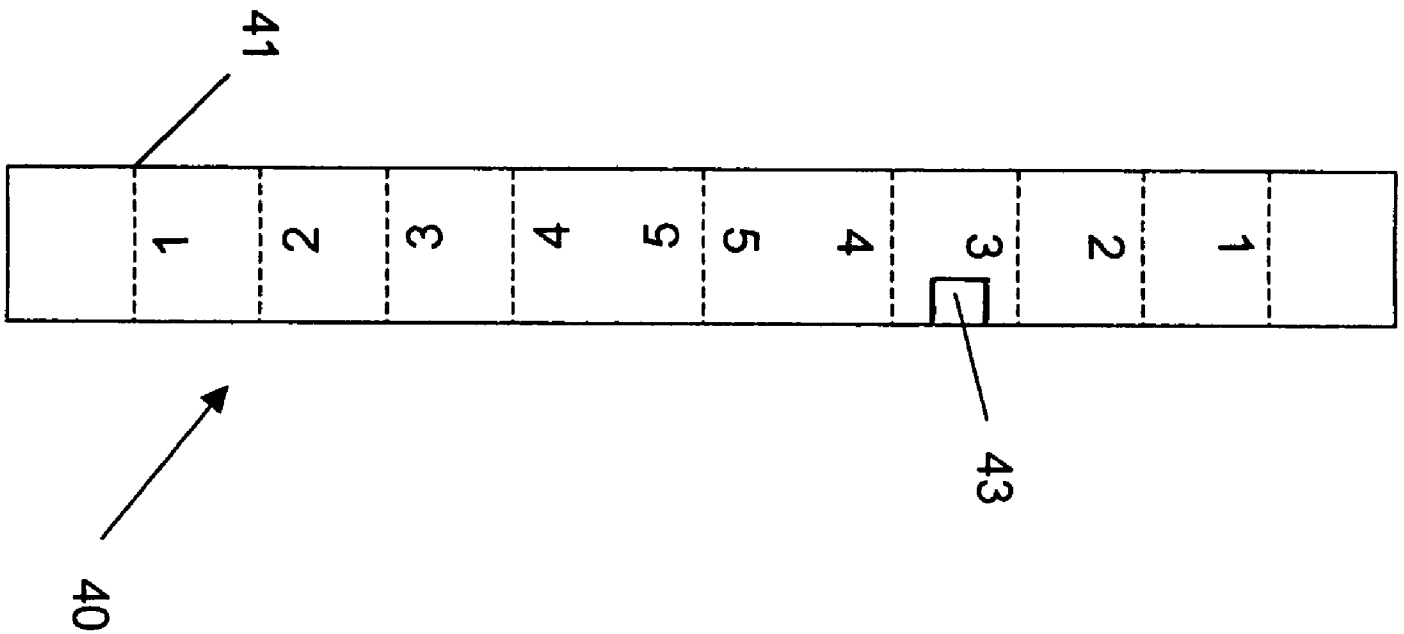
FIG. 3 is a top plan view of the detachable strap of the present invention, which connects the standards to one another

As shown in FIG. 3, a strap 40 is provided. The strap 40 connects the two standards 2 to each other. The strap 40 may be of a cargo netting type material or any other material that will not stretch when pulled on axially. The strap 40 is of such a length that the pointers 21 are spaced at exactly ten yards from one another. Therefore, if the pointers 21 on each standard 2 are on the outside (not between the standards 2), the strap will be shorter than ten yards by the distance between the pointers 21 and each respective end of the strap 40. Conversely, if the pointers 21 are provided between the standards 2 (FIG. 2), then the strap 40 will have to be longer than ten yards by the distance between the pointers 21 and each respective end of the strap 40.

Figure 5:
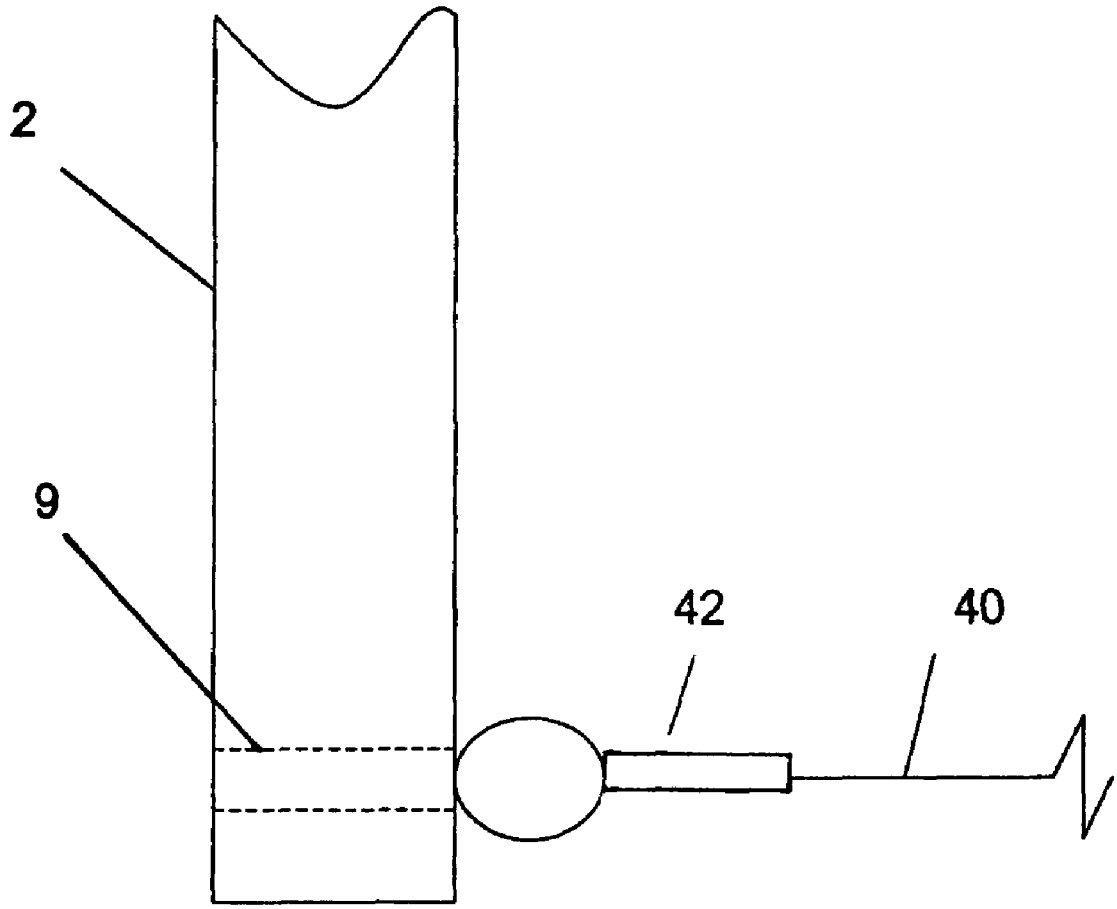
FIG. 5 is an enlarged partial side view of a standard according to the present invention showing an attachment for the strap.

The strap 40 includes graduations 41 that are labeled from 1 to 5 starting from the ends of the strap 40 at each standard and moving to the center of the strap. The graduations 41 are spaced at one-yard increments beginning at 1 yard from each respective pointer 21. The graduations 41 can be used to easily determine the remaining yardage required for obtaining a first down. The strap 40 is connected to the standards 2 at its ends by clip-on fasteners 42. The clip-on fasteners 42 may be fastened to the standards 2 by any suitable measures such as an eyebolt 9, as shown in FIG. 5. The clip-on fasteners 42 provide for easy removal of the strap 40 from the standards 2. The detachable strap 40 prevents other injuries when moving the chains onto the field for a measurement and at the completion of the quarter.

In order to ensure that the pointers 21 are spaced at exactly ten yards the pointers 21 must be have a consistent angular orientation to the strap 40 and thus the standards 2. Preferably, the orientation of the pointers 21 is perpendicular to the strap 40. As noted above, the clip 22 has a locator that provides an accurate angular orientation of the pointers 21 to the strap 40 and the standards 2 or alternatively, the pointer assembly 20 may be rigidly affixed to the respective standard in the correct orientation.

In the event that a measurement needs to be made on the field, the strap 40 is unclipped from the rear standard 2 and a jawed clip 43 is clamped in a fixed or locked manner onto the strap 40 at a desired yard line on the sideline. The jawed clip 43 establishes the positioning of the chain set on the field by allowing a placement of the jawed clip 43 at the same yard line on the field at which it was clamped on the sideline. This ensures the accuracy of the measurement on the field.

I claim:

1. A football down chain set for monitoring the position of a football, the chain set comprising:

a standard having a pointer attached thereon, said pointer being spaced at a distance from said standard, said pointer gauging a position of the football;

another standard having another pointer attached thereon, said other pointer being spaced at a distance from said other standard, said other pointer gauging a position of the football;

a strap interconnecting said standard and said other standard, said strap being dimensioned for providing a spacing of ten yards between said pointer and said other pointer;

said pointers being constructed to rotate about an axis that is parallel to said strap.

2. The football down chain set according to claim 1, wherein said standards have a break away construction.

3. The football down chain set according to claim 2, wherein said standards each have respective pole segments held together by an elastic cord.

4. The football down chain set according to claim 3, wherein one of said pole segments is disposed inside the other of said pole segments, which has a cutout for allowing said pole segments to break away from each other.

5. The football down chain set according to claim 1, wherein said strap has graduations spaced at one yard increments, said graduations being labeled from 1 to 5 in a direction from the standards towards a center of the strap.

6. The football down chain set according to claim 5, wherein said standards each have respective eye bolts, said strap is attached to said eye bolts by clip on fasteners.

7. The football down chain set according to claim 1, further comprising a down marker for indicating a current down and a line of scrimmage.

8. The football down chain set according to claim 7, wherein said down marker has a mesh banner indicator for indicating a current down and said standards each have respective mesh banner directional indicators.

9. The football down chain set according to claim 1, wherein said pointers are perpendicular to said strap.

10. The football down chain set according to claim 1, further comprising a respective pointer assembly for each said standard, each said pointer assembly having an extension tube connected to a clip for attaching to the respective standard, one of said pointers being connected to said extension tube for establishing said spacing, said pointer assembly being constructed for allowing a respective said pointer to rotate about an axis parallel to said strap.

11. The football down chain set according to claim 10, wherein said pointers are perpendicular to said strap.

12. The football down chain set according to claim 10, further comprising an elastic band for holding said extension tube securely against said clip.

13. The football down chain set according to claim 1, further comprising a jawed clip for clamping onto said strap in a locked manner, said jawed clip aligning the chain set during an on field measurement.

14. The football down chain set according to claim 1, wherein said pointer is flexible.

15. The football down chain set according to claim 1, wherein said pointers are constructed to rotate about a longitudinal axis of said standard.

16. A method for safely spacing apart markers during a football game, the method comprising the following steps:

providing standards each having a respective pointer attached thereon, the respective pointer being spaced at a distance from the standard, the pointers gauging a position of the football, a strap interconnecting the standards, the strap being dimensioned for providing a spacing of ten yards between the pointers, the pointers being constructed to rotate about an axis that is parallel to said strap, and a down marker for indicating the down and the line of scrimmage;

placing the down marker at the corresponding pointer when ten yards remain for a first down, thereby safely spacing members of a chain crew from one another.

17. A football down chain set for monitoring the position of a football, the chain set comprising:

a standard having a pointer attached thereon, said pointer being spaced at a distance from said standard, said pointer gauging a position of the football;

another standard having another pointer attached thereon, said other pointer being spaced at a distance from said other standard, said other pointer gauging a position of the football;

said standards having a break away construction, and said standards each having respective pole segments held together by an elastic cord;

a strap interconnecting said standard and said other standard, said strap being dimensioned for providing a spacing of ten yards between said pointer and said other pointer.

* * * * *